United States Patent [19]

Herrmann

[11] Patent Number: 4,874,040

[45] Date of Patent: Oct. 17, 1989

[54] UNIVERSAL HEAT EXCHANGER

[76] Inventor: Donald C. Herrmann, 6902 Doral, North Lauderdale, Fla. 33068

[21] Appl. No.: 214,427

[22] Filed: Jul. 1, 1988

[51] Int. Cl.[4] ..... F24H 3/06; F28H 13/12

[52] U.S. Cl. ..... 165/122; 165/123; 165/126; 165/127; 165/1; 165/97; 62/259.1; 62/263; 62/DIG. 16

[58] Field of Search ..... 165/122, 123, 126, 127, 165/1, 97; 62/259.1, 263, DIG. 16

[56] References Cited

U.S. PATENT DOCUMENTS

| | | | |
|---|---|---|---|
| 3,012,762 | 12/1961 | Norris . | |
| 3,251,406 | 5/1966 | Lauer . | |
| 3,441,082 | 4/1969 | Fragnits et al. | 165/123 |
| 3,465,816 | 9/1969 | Fichtner . | |
| 3,470,945 | 10/1969 | Schmidt | 165/123 X |
| 3,583,175 | 6/1971 | Eubank . | |
| 3,628,590 | 12/1971 | Knebuoch | 165/122 X |
| 3,722,580 | 3/1973 | Braver . | |
| 3,742,725 | 7/1973 | Berger . | |
| 3,977,467 | 8/1976 | Northrup, Jr. | 165/122 X |
| 4,139,052 | 2/1979 | Lackey . | |
| 4,293,032 | 10/1981 | Asp | 165/122 X |
| 4,544,023 | 10/1985 | Marciniak . | |

OTHER PUBLICATIONS

Trane Publication, "Central Station Climate Horizontal Draw-Thru Units".

McQuay Catalog #264, "Commercial Rooftop Heating & Cooling Units", p. 4.

York Pathfinder IV Single Package Air Conditioners.

Carrier Catalog Pages, 313, 317, 498, 503, 504, 522, 643, 644, 658, 718, 908.

Trane Pub. No. 22-1086-12, Mar. 1985, pp. 21, 26. "Air Conditioner Single Package", 3/1985.

Trane Publ. No. 22-1085-9, p. 15. "Elite Air Conditioner" 3/1985.

FHP (Florida Heat Pump), "Energy Miser Environment Systems", Three Pages of Technical Drawings, 12/1981, 9/1985.

*Primary Examiner*—Larry Jones

*Attorney, Agent, or Firm*—Jerry A. Miller

[57] ABSTRACT

A heat exchanger for use where any of a number of possible configurations of ductwork are possible, includes an approximately rectangular housing having a first panel with a surface area and with four corners including a first and a second corner situated diagonally opposite one another, and a third and fourth corner situated diagonally opposite one another. A heat exchanger is coupled to the panel situated approximately diagonally within the housing spanning from approximately the third corner to the fourth corner such that the housing is partitioned into a first chamber adjacent the first corner and a second chamber adjacent the second corner. A first duct is situated near the first corner on the first panel and occupying less than approximately ¼ of the surface area, for coupling air to the first chamber. A second duct is situated near the second corner on the first panel and occupying less than approximately ¼ of the surface area, for coupling air from the second chamber. A fan is coupled to the first panel and situated within one of the first and second chambers for forcing air to pass by the heat exchanger and thereby pass from the first chamber to the second chamber. The configuration of the invention may be changed by removal of the panel, rotation and reinstallation of the panel.

13 Claims, 3 Drawing Sheets

UNIVERSAL HEAT EXCHANGER

BACKGROUND OF THE INVENTION

1. Field of the invention

This invention relates generally to heat exchanger devices. More particularly, this invention relates to a universal air handler heat exchanger for air conditioning heating, ventilating and heat pump systems and the like.

2. Background

There exists a need for a heat exchanger for commercial and residential air conditioning and heating systems which is capable of use in a variety of applications. This need is evidenced by the increasingly large number of models of such devices produced by various manufacturers with virtually no standardization even among devices produced by the same manufacturer. In particular, there are endless configurations of supply and return ductwork which must be dealt with when replacing such devices. A relatively large segment of these devices utilize a common surface for both intake and exhaust ductwork Due to the large number of configurations of existing air handlers, the present invention is particularly well suited to replace these particular devices when they become defective. In addition, due to the versatility of the present air handler configuration, it provides a versatile unit for original installations.

There are a number of patents which deal with the problem of facilitating air flow paths in a number of different arrangements. This is usually accomplished by use of simple moveable panels which can be rearranged, covered and otherwise modified at the site of installation to adapt to various conditions by changing the location of simple panels containing the supply or return apertures. The term 'simple moveable panel' is used to mean a panel alone which only moves the location of an aperture when moved. Representative of such patents are U.S. Pat. Nos. 3,583,175 and 4,139,052 which are incorporated herein by reference. This is the technique generally used in commercially available products by various manufacturers. In some units, the supply and returns may also be a altered by use of various adapters, however, this necessarily adds substantial size to the unit.

Such commercial products are unfortunately quite limited in the adaptability of any particular unit with typically only one or two options for reconfiguration available. This necessitates that when devices are replaced they generally require an exact replacement with substitution of one manufacturer for the other being generally quite difficult. To further add to the problem, the requirement for high energy efficiency typically means that the replacement units are physically larger (to accommodate a larger heat exchanger) than the unit being replaced.

Because of the wide diversity of such designs, the manufacturing cost is often quite high due to lack of full exploitation of economies of scale. Similarly, distributors must stock a substantial inventory of replacement units and bear the associated costs. The additional material and labor costs are of course passed on to the consumer.

Design considerations for designing heat exchange devices such as the present invention are described in the 1988 ASHREA Handbook, American Society of Heating, Refrigeration, and Air-Conditioning Engineers, Inc., Atlanta, Georgia, which is incorporated by reference.

The present invention seeks to ameliorate these and other problems associated with the prior art. The present invention provides advantages and features which are not contemplated by the prior art as will be appreciated after consideration of the following description taken in conjunction with the accompanying drawings.

SUMMARY OF THE INVENTION

Accordingly, it is an object of the present invention to provide an improved heat exchanger configuration which provides substantial variability in order to adapt to various types of ductwork.

It is another object of the present invention to provide an air handler which may be used as a replacement for a variety of air handlers manufactured by a variety of manufacturers.

It is a further object of the present invention to provide an air handler configuration which may be used in any of a number of configurations by simply rotating a panel of the cabinet which carries air handler components to provide appropriate ductwork access.

It is an advantage of the present invention to provide a heat exchanger configuration which is compact while providing a substantial heat exchange surface area.

In one embodiment of the present invention a heat exchanger for use where any of a number of possible configurations of ductwork are possible, includes an approximately rectangular housing having a panel with a surface area and with four corners including a first and a second corner situated diagonally opposite one another, and a third and fourth corner situated diagonally opposite one another. A heat exchanger is situated approximately diagonally within the housing spanning from approximately the third corner to the fourth corner such that the housing is partitioned into a first chamber adjacent the first corner and a second chamber adjacent the second corner. A first aperture is situated near the first corner on the panel and occupies less than approximately 1/4 of the surface area, for coupling air to the first chamber. A second aperture is situated near the second corner on the panel and occupying less than approximately 1/4 of the surface area, for coupling air from the second chamber. A fan is connected to the first surface and situated within one of the first and second chambers for forcing air to pass by the heat exchanger and thereby pass from the first chamber to the second chamber.

In another embodiment of the present invention a method of replacing an air handler in an air conditioning system comprises the steps of removing a defective air handler, the defective air handler having a predetermined supply and return aperture configuration on a surface thereof connected to a supply duct and a return duct; providing a replacement air handler with supply and return apertures adjacent opposing corners of a surface thereof; rotating at least a portion of the replacement air handler to one of a plurality of positions to provide a closest mating to the supply and return ducts; and connecting the supply and return ducts to the replacement air handler.

These and other objects, features, and advantages of the invention will become apparent to those skilled in the art upon consideration of the following detailed description taken in conjunction with the accompanying drawings.

DETAILED DESCRIPTION OF THE INVENTION

Figure 1:
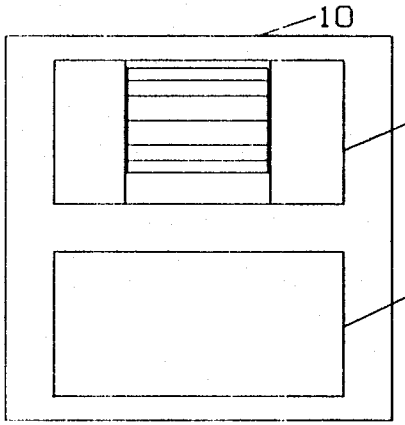
FIG. 1 is an illustration of the supply and return aperture configuration of one type of air handler.

Turning now to the drawings wherein like reference numerals designate identical or corresponding parts throughout the several views, and more particularly to FIG. 1 thereof, there is shown an air handler of a first configuration. In this configuration, as in the other configurations discussed herein, the air handler is enclosed in a housing or cabinet 10. This cabinet 10 has an opening, referred to herein as a supply or supply aperture or supply outlet 12 for supply air flow and a opening referred to herein as a return or return aperture or return inlet 14 for return air. In operation, air is drawn through the return inlet 14, passed through a heat exchanger and expelled through the supply outlet 12. In this configuration, the supply outlet 12 is situated directly above the return inlet 14.

Figure 2:
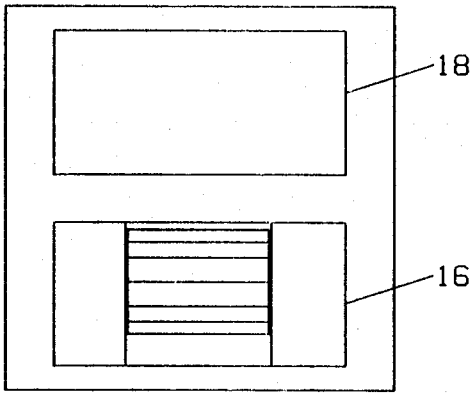
FIG. 2 is an illustration of the aperture configuration of a second type of air handler.

Turning now to FIG. 2, a second common configuration is shown in which a supply outlet 16 is situated below a return inlet 18. Clearly, these first two configurations are mutually incompatible and one could not normally be substituted for the other without substantial field modification and inefficient ductwork rerouting. Since it typically takes approximately 18 inches of ductwork to provide a 90 degree transition, attempts to adapt these two configurations as replacements for one another are seldom appropriate.

Figure 3:
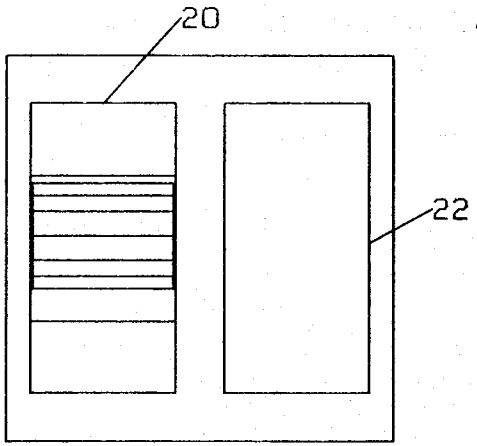
FIG. 3 is an illustration of the aperture configuration of a third type of air handler.

Turning now to FIG. 3, a third common configuration is shown in which a supply 20 is situated adjacent a return 22 with the supply on the left and the return on the right. Except in rare circumstances, this configuration could not be substituted for either of the configurations shown in FIGS. 1 or 2 without costly additional transitional ductwork which will add at least 18 inches to one dimension of the installation.

Figure 4:
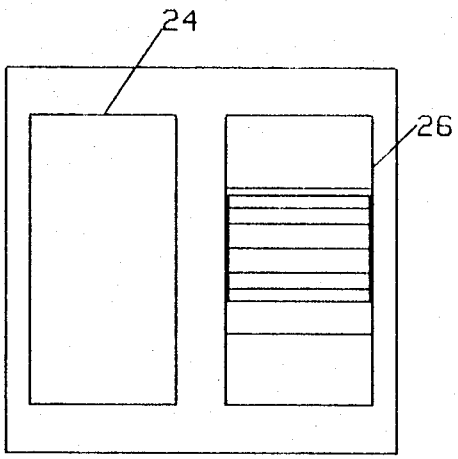
FIG. 4 is an illustration of the aperture configuration of a fourth type of air handler.

FIG. 4, similarly, shows a side by side configuration in which a return 24 is to the left of a supply 26. This configuration could not be used in most circumstances to replace the configurations of FIGS. 1–3 without a similar objectionable use of transition ducts.

Other variations of these configurations exist with each cabinet having a defined top and bottom which establishes the configuration in a somewhat inflexible manner leading to the aforementioned problems. While many make provisions for movable panels and alternate supply and return apertures on different surfaces of the cabinet, no known configuration currently exists which can be substituted into all of these configurations with minimal reconfiguration of ductwork.

Figure 5:
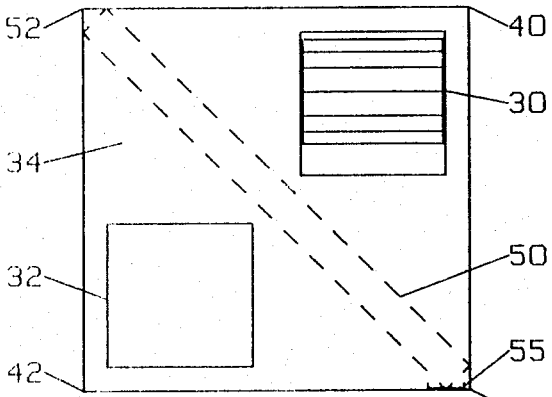
FIG. 5 is an illustration of the aperture configuration of the air handler of the present invention in a configuration suitable for substitution for the air handler of FIG. 1 and FIG. 4

Turning now to FIG. 5, one configuration of the present invention is shown. In the preferred embodiment the enclosure can be made square. This is not to be limiting, however, since the invention can be generalized to provide for a more common rectangular configuration. Other configurations may be possible without departing from the spirit of the invention. This configuration uses a diagonally opposite positioning of a supply aperture 30 and a return aperture 32 situated on a common face panel 34 of a rectangular (square) enclosure (or cabinet or housing) 36 (shown in FIG. 9). The supply aperture 30 is situated near corner 40 with the return aperture 32 situated near corner 42. Although illustrated as square or rectangular, circular openings could also be provided, as could any convenient shape.

The heat exchange element (e.g. evaporator, condenser) 50, shown in broken lines is situated within the cabinet 36 extending from approximately corner 52 to corner 54. In addition to facilitating the placement of the supply and return, this placement of the heat exchange element 50 provides added efficiency over more standard vertical and horizontal placement by allowing the heat exchange element 50 to be a substantial measure larger than if it were horizontal or vertical.

This diagonal placement of the heat exchange element 50 defines two cavities, a return cavity (56 of FIG. 9) for return air and a supply cavity (58 of FIG. 9) for supply air. Each of these cavities occupy a bit less than approximately half of the volume of the enclosure 36. The line of demarcation between these two chambers extends approximately diagonally from corner 52 to corner 54. In order to return or supply air exclusively to one or the other chamber, and to ensure the adaptability to any of the configurations of FIGS. 1–4, it is preferable for the supply aperture 30 as well as the return aperture 32 occupy somewhat less than ¼ of the surface area of face 34.

If the heat exchange element 50 is prone to condensation on the exterior, as in a evaporator for an air conditioner, the cabinet should be provided with a drain pan 55 at the lower corner where the bottom of the evaporator rests so that, the condensation can be drained away. The cabinet can be provided with a conventional drain to drain away the condensate.

In the arrangement shown in FIG. 5, the present air handler can directly replace either the air handler of FIG. 1 or FIG. 4. This is accomplished by simply attaching an appropriate adaptor which mates the existing ductwork connector to the face 34 in a manner such that the duct work completely mates with the supply 30 and return 32. Although the sizes of the ducts are often different than the sizes of the supply aperture 30 and return aperture 32, adaption is a simple manner. The duct may be attached by any of a number of known methods including taping and riveting. If suitable adapters are not available, often they can be fashioned on the spot with sheet metal stock or the connection can simply be taped off as is a common practice. In most situations where supply 30 and return 32 are smaller than the ductwork, it is anticipated that restricted air flow resulting from the smaller apertures will not be a serious consideration though most ductwork is considerably larger. In fact, the size of many return apertures are determined by the size of the heat exchangers situated vertically behind them.

Figure 6:
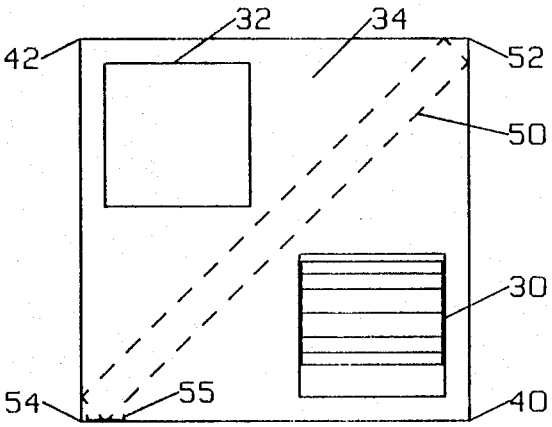
FIG. 6 is an illustration of the aperture configuration of another embodiment the air handler of the present invention in a configuration suitable for substitution for the air handler of FIG. 2 and FIG. 4.

Turning now to FIG. 6, an alternate embodiment to that shown in FIG. 5 is shown. The heat exchange element 50 of FIG. 5 slopes downward from left to right while the embodiment shown in FIG. 6 slopes downward from right to left. This configuration as shown is suitable for replacement of the device of FIG. 2 or FIG. 4. As will be appreciated, this device is entirely equivalent to that of FIG. 5.

According to the present invention, the supply and return apertures along with a blower fan are attached to the front panel and can be rotated by 180 degrees to effect a change in configuration. To allow for the various positions in which the present air handler may be installed, the motor used to power the fan should preferably have sealed bearings or permanent lubrication rather than oil cups in the preferred embodiment so that the motor orientation is not critical. Of course, by making provision for proper rotation of the fan, fans using oil cups could also be used. The heat exchanger 50 is preferably mounted within the cabinet so that rotation of the face panel 34 effects an exchange of designated supply and return chambers as will be appreciated later.

Figure 7:
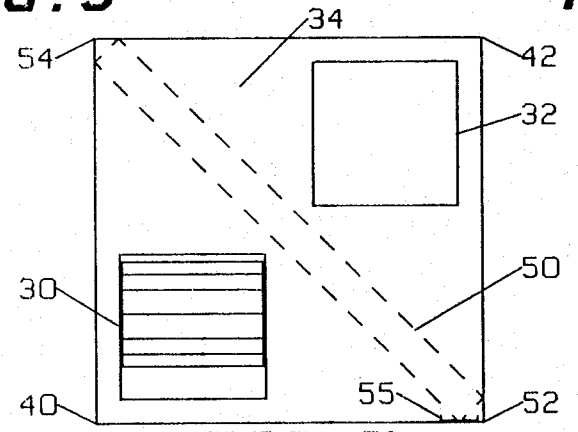
FIG. 7 is an illustration of the aperture configuration of the air handler of FIG. 5 with the face panel rotated to a configuration suitable for substitution for the air handler of FIG. 2 and FIG. 3.

In the configuration shown in FIG. 7, the device of FIG. 5 is shown with the face panel 34 rotated by 180 degrees. In this configuration, the present air handler can be used to replace those of FIG. 2 and FIG. 3. The 180 degree rotation can be accomplished for either square or rectangular configurations. The rotation process involves removing screws or other suitable fasteners holding on the face panel and the two side panels, disconnecting the fan from a mounting bracket, sliding the panel out, rotating the panel by 180 degrees, sliding the panel back in place and reattaching it, attaching the fan to a second mounting bracket, and replacing the side panels. Of course, a rerouting of wiring to the fan may also be required.

Figure 8:
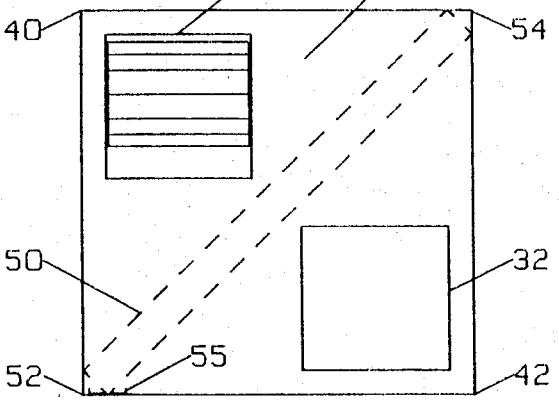
FIG. 8 is an illustration of the aperture configuration of the air handler of FIG. 6 with the face panel rotated to a configuration suitable for substitution for the air handler of FIG. 1 and FIG. 3.

A similar change in configuration can be effected for the embodiment of FIG. 6 to convert it to the configuration of FIG. 8. This configuration shows the present air handler face panel has again been rotated by 180 degrees from its original position and may now be used to replace either of FIG. 1 or FIG. 3. In addition to these configurations, the air handler of the present invention may be used to replace most other possible configurations having supply and return on the same face of the enclosure, providing of course that the capacities and physical sizes are comparable. By using the known prior art techniques of simple movable panels and replaceable panels for shifting apertures alone, further versatility can be attained to allow moving one or both apertures to the top, side, back or bottom of the enclosure.

The present invention may be used either for initial installations, or in replacement of defective air handlers. In replacing an air handler the defective air handler is removed. The replacement air handler's face panel with its attached components (fan, heater, etc.) is then rotated to one of a plurality of positions to provide a closest mating to the supply and return ducts of the defective air handler. The supply and return ducts can then be adapted to the replacement air handler.

Figure 9:
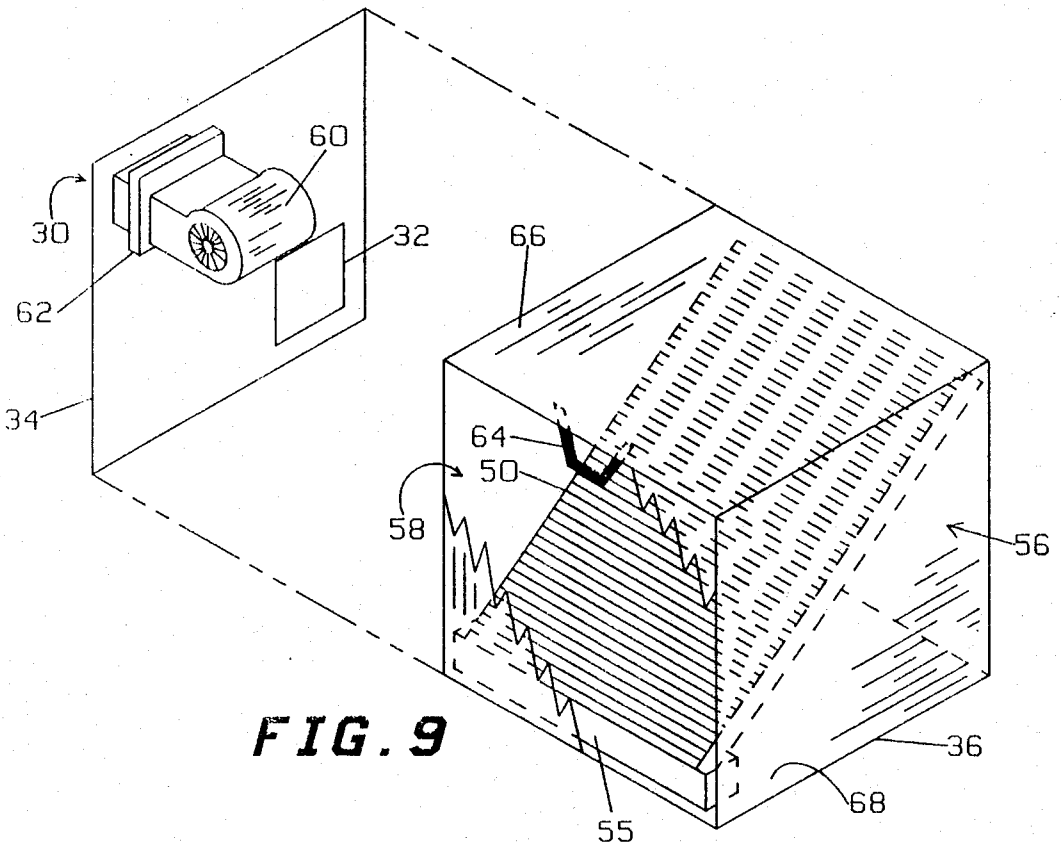
FIG. 9 is a partially exploded view of the air handler of the present invention showing the face panel separated from the cabinet.

Turning now to FIG. 9, a view of the air handler of the present invention with the front panel 34 and associated assemblies separated from the remainder of the housing 36 is shown with supply 30 and return 32. A fan 60 is connected to a heater coil 62 and in turn to face panel 34 and blows air from supply aperture 30. Return air is pulled through the return chamber 56 behind the heat exchange element 50 through heat exchange element 50 to the supply chamber 58 and out through supply 30. The heat exchange element 50 is connected to the housing 36 panel so that removal of the face panel in effect removes the supply, return, fan and heater. The heat exchange element is preferably rigidly attached to the top corner of the housing an rests within drain pan 55 at the bottom of the housing to facilitate collection and removal of condensate. The heater 62 may be omitted in units which only require cooling.

A mounting bracket 64 is provided on a top surface 66 as well as a lower surface 68 (not shown) of the housing 36 to provide mechanical support for the fan 60 and heater 62. When the unit is configured as shown, the bracket 64 connected to the top surface 66 is used to support the fan. When the face panel 34 is rotated 180 degrees, the fan 60 is disconnected from the bracket 64 (via access provided through a side panel) and reattached to the bracket connected to the bottom surface 68.

Figure 10:
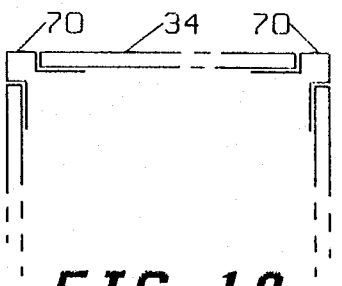
FIG. 10 shows a preferred mounting arrangement for the panels of the cabinet.

In the preferred embodiment, the cabinet is constructed so that the face panel 34 to which the fan, fan housing, motor and heater, when applicable, is mounted, may be unbolted, rotated 180 degrees and re-bolted to the unit. Any of the configurations of FIGS. 1–4 can be handled with only a single 180 degree rotation of the face panel. FIG. 10 shows a preferred mounting technique for the panels in which a corner support member 70 contains two rabbets on two adjacent sides within which the panels may be placed at right angles and secured with screws, bolts, etc. Preferably, all panels are the same size to allow for enhanced versatility and economies of scale.

The unique configuration of the components allows the unit to adapt to any of four general configurations as shown in FIGS. 1–4, two in each of the rotated positions. In other embodiments, the entire housing may be adapted so that it can be rotated to provide the same desired effect. Such adaptation merely requires provision for mounting the housing in one of two possible orientations. In other variations, other suitable components may be mounted on the face and rotated along with the face panel. Those skilled in the art will appreciate other variations.

The fan 60 (along with fan housing and motor), and when applicable, electric heater are mounted to the rotatable panel 34 and their location is changed when the panel 34 is rotated. The cabinet and all other components of the system preferably, but not necessarily, remain stationary during the rotating process. The wiring for the motor and the heater may require rerouting and reconnection during the rotation process. The cabinet may be constructed of any suitable material which can be fastened together in a suitable manor to house the required components. Fresh air dampers, relief dampers and the like can be accommodated in known manners such as those shown in U.S. Pat. No. 4,139,052 which is incorporated by reference herein.

It is generally recommended that the return ductwork provide two 90 degree bends to reduce noise. The present invention inherently provides 90 degrees of bend with respect to the heat exchanger and another 90 degrees with respect to the fan. This should generally enhance the noise properties of the present invention. The versatile ductwork arrangement requires only about 6 inches or so of ductwork adaption to facilitate connection to any of the target original equipment's ductwork.

In the preferred embodiment, the heat exchanger 50 is an evaporator. However, the design configuration is equally applicable when used for the condenser side of an air conditioning system, if the application proved to be beneficial (i.e., to gain more condenser surface area). Additionally, the configuration may be used for heat pump as well as straight cool applications and could be used in conjunction with any type condensing section as well as incorporating the entire system in one package.

The heat exchangers may be of any type currently used for the transfer of heat, however, a tube and fin type is preferred for this design. A heat transfer fluid may be circulated through the tubes, by a source of energy either inside or outside the unit, while air is drawn through the air inlet and across the heat exchanger by the fan. Heat is absorbed by or dissipated to the heat transfer fluid causing the desired effect of cooling or heating in the conventional manner. The fan 60 then discharges the cooled or heated air to the outer side of the cabinet 36. The unit may be free standing or connected to a duct system as required, to distribute the desired effect where needed. An electric heater may me inserted in a space provided between the outlet of the blower housing and the outer side of the unit, if electric heating is required.

Wiring for the fan 60 and heater 62 can be accommodated by electrical panels situated within the cabinet 36. Since the cabinet is essentially bisected into two chambers by the heat exchanger, either duplicate electrical wiring can be provided in each chamber or the wiring can be rerouted in the installation process.

By appropriate sealing of the enclosure, the air handler may be either used in indoor or outdoor applications. The versatility of the present air handler substantially reduces the need for stocking a wide selection of air handlers of similar capacity since this unit can replace such a wide variety of configurations. In addition to use in so called split units where a separate air handler and compressor units are used, the present configuration is also well suited to self contained air conditioner or heat pumps which must mate to a variety of existing ductwork. In this variation, the supply and return chambers may be used to house additional components which are not needed for the air handler embodiment such as electronic air cleaners or humidifiers and the like. Although the fan has been shown arranged so as to aspirate air through the housing, it could similarly be arranged to blow air through the housing without departing from the invention. Other modifications will occur to those skilled in the art.

Thus, it is apparent that in accordance with the present invention, a method and apparatus that fully satisfies the aims, advantages and objectives is set forth above. While the invention has been described in conjunction with specific embodiments, it is evident that many alterations, variations and modifications will become apparent to those skilled in the art in light of the foregoing description. Accordingly, it is intended that the present invention embrace all such alternatives, modifications and variations as fall within the spirit and broad scope of the appended claims.

What is claimed as new and desired to be secured by Letters Patent of the United States is:

1. A heat exchanger for use in any of a number of possible configurations, comprising in combination:

a rectangular housing means having a top, a bottom and a removable first panel, said first panel having a first surface having surface area and with four corners including a first and a second corner situated diagonally opposite one another, and a third and fourth corner situated diagonally opposite one another;

heat exchanging means situated approximately diagonally within said housing spanning from approximately said third corner to said fourth corner such that said housing is partitioned into a first chamber adjacent said first corner and a second chamber adjacent said second corner;

return means, situated near first corner on said first surface and occupying less than approximately ¼ of said surface area, for coupling air to said first chamber;

supply means, situated near said second corner on said first surface and occupying less than approximately ¼ of said surface area, for coupling air from said second chamber; and air circulation means, situated within one of said first and second chambers and coupled to said first panel, for forcing air to pass by said heat exchanging means and thereby pass from said first chamber to said second chamber; whereby, said first panel may be rotated by 180 degrees to reverse the direction of air flow through said heat exchanging means and reverse the orientation of said supply means and said return means.

2. The apparatus of claim 1, wherein said air circulation means includes a fan attached to said first panel.

3. The apparatus of claim 2, further comprising a heating coil situated between said fan and said first panel.

4. The apparatus of claim 1, further including a heater coil situated within said housing.

5. The apparatus of claim 1, further comprising supporting means attached to said top and said bottom so that said fan may be supported by said support means in either of two configurations obtainable by rotation of said panel.

6. The apparatus of claim 1, wherein said heat exchanging means comprises an evaporator.

7. The apparatus of claim 6, further comprising draining means, situated below said evaporator, for facilitating removal of condensate.

8. The apparatus of claim 1, wherein said heat exchanging means comprises a condenser.

9. A heat exchanger for use in any of a number of possible configurations, comprising in combination:

a rectangular housing means having a top a bottom and a first panel, said first panel having a first surface having surface area and with four corners including a first and a second corner situated diagonally opposite one another, and a third and fourth corner situated diagonally opposite one another;

said panel being removable from said housing means so that the panel can be rotated to effect a change in configurations of said first and second ducting means;

heat exchanging means including an evaporator situated approximately diagonally within said housing spanning from approximately said third corner to said fourth corner such that said housing is partitioned into a first chamber adjacent said first corner and a second chamber adjacent said second corner;

return means, situated near said first corner on said first surface and occupying less than approximately ¼ of said surface area, for coupling air to said first chamber;

supply means, situated near said second corner on said first surface and occupying less than approximately ¼ of said surface area, for coupling air from said second chamber;

a fan, situated within one of said first and second chambers and coupled to said face panel, for forcing air to pass by said heat exchanging means and thereby pass from said first chamber to said second chamber;

first and second supporting brackets attached to said top and bottom so that said fan may be supported by said support means in either of two configurations obtainable by rotation of said panel;

a heater coil situated between said fan and said first panel; and a drain pan situated below said evaporator for facilitating removal of condensate from said housing means; whereby, rotation of said panel causes a reversal of direction of air flow through said heat exchanging means.

10. A method of replacing an air handler in an air conditioning system comprises the steps of:

removing a defective air handler, said defective air handler having a predetermined supply aperture and return aperture configuration on a surface thereof connected to a supply duct and a return duct;

providing a replacement air handler with supply and return apertures adjacent opposing corners of a surface thereof;

rotating at least a portion of said replacement air handler to one of a plurality of positions to provide a closest mating between said supply aperture and said supply duct and said return aperture and said return duct and to effect a change in direction of air flow through a heat exchanger within said replacement air handler; and connecting said supply and return ducts to said replacement air handler.

11. The method of claim 10, wherein said rotating step includes the step of rotating a first panel, said first panel being coupled to a fan and including means defining a return aperture and a supply aperture so that rotation of said panel effects a reconfiguration of said supply aperture and return aperture.

12. The met hod of claim 10, further comprising the step of routing wiring for said fan so that electrical power can be provided to said fan after said rotation.

13. The method of claim 10, further comprising the steps of disconnecting said fan from a first bracket and reconnecting said fan to a second bracket.

* * * * *